US007659866B1

(12) United States Patent
Peng et al.

(10) Patent No.: US 7,659,866 B1
(45) Date of Patent: Feb. 9, 2010

(54) MULTIPLE FREQUENCY BAND ANTENNA

(75) Inventors: Huang-Tse Peng, Taipei (TW); Kuo-Jen Lai, Taipei (TW); E-Den Hsiao, Taipei (TW)

(73) Assignee: Arima Communications Co., Ltd., Taipei County (TW)

( * ) Notice: Subject to any disclaimer, the term of this patent is extended or adjusted under 35 U.S.C. 154(b) by 21 days.

(21) Appl. No.: 12/173,421

(22) Filed: Jul. 15, 2008

(51) Int. Cl.
*H01Q 1/24* (2006.01)
*H01Q 21/30* (2006.01)

(52) U.S. Cl. ..... 343/893; 343/702; 343/828

(58) Field of Classification Search ..... 343/700 MS, 343/702, 828, 846, 893
See application file for complete search history.

(56) References Cited

U.S. PATENT DOCUMENTS 6,819,287 B2 * 11/2004 Sullivan et al. ..... 343/700 MS
7,119,747 B2 * 10/2006 Lin et al. ..... 343/702
7,541,984 B2 * 6/2009 Peng et al. ..... 343/700 MS

* cited by examiner

*Primary Examiner*—Michael C Wimer
(74) *Attorney, Agent, or Firm*—Kirton & McConkie; Evan R. Witt

(57) ABSTRACT

A multiple frequency band antenna includes a common connecting element, a first radiating element, a second radiating element, a common feeding point and a common ground terminal. The common connecting element includes a connecting part and a turning part, which are arranged in different planes. The first radiating element is connected with the connecting part of the common connecting element. The second radiating element is connected with the turning part of the common connecting element. The second radiating element has a longer path length compared with the first radiating element. A combination of the common connecting element and the first radiating element is configured to transmit and receive wireless signals in a first frequency band. A combination of the common connecting element and the second radiating element is configured to transmit and receive wireless signals in a second frequency band.

19 Claims, 7 Drawing Sheets

3

MULTIPLE FREQUENCY BAND ANTENNA

FIELD OF THE INVENTION

The present invention relates to an antenna, and more particularly to a multiple frequency band antenna for use in a wireless communication device.

BACKGROUND OF THE INVENTION

In recent years, the development of the wireless communication industry is vigorous. The wireless communication devices, for example, cell phones or PDAs, have become indispensable commodities for people. An antenna generally plays an important role for transmitting and receiving wireless signals in a wireless communication device. Therefore, the operating characteristics of the antenna have a direct impact on the transmission and receiving quality for the wireless communication device.

Generally, the antenna of the portable wireless communication device is roughly classified into two categories, including the external type antenna and embedded type antenna. The external type antenna is commonly shaped as a helical antenna, and the embedded type antenna is commonly shaped as a planar inverted-F antenna (PIFA). The helical antenna is exposed to the exterior of the casing of the wireless communication device and is prone to be damaged. Thus, the helical antenna usually bears a poor communication quality. A planar inverted-F antenna has a simple structure and a small size and is easily integrated with electronic circuits. Nowadays, planar inverted-F antenna has been widely employed in a variety of electronic devices.

Typically, a well-designed antenna is required to have a low return loss and a high operating bandwidth. In order to allow the user of the wireless communication device to receive wireless signals with great convenience and high quality, the current wireless communication devices have been enhanced by increasing the number of antennas or enlarge the antenna to allow the wireless communication device to transmit and receive wireless signals with a larger bandwidth or multiple frequency bands. However, with the integration of circuit elements and the miniaturization of the wireless communication device, the conventional design method has been outdated.

For allowing the wireless communication device to increase the number of antennas in the limited receiving space so as to transmit and receive wireless signals with a larger bandwidth and a better transmission quality and performance, the structure of the antenna has been modified. Referring to FIG. 1, the structure of a conventional multiple frequency band antenna is shown. As shown in FIG. 1, the conventional multiple frequency band antenna 1 is a planar inverted-F antenna, which includes a first radiating element 11 and a second radiating element 12. Moreover, a feeding point 13 and a first ground terminal 14 are disposed at one side of the distal region of the second radiating element 12. The distal region of the first radiating element 11 and the distal region of the second radiating element 12 are connected with each other. The first radiating element 11 is bent for two times to partially enclose the turning part of the second radiating element 12 but separated from the second radiating element 12. The multiple frequency band antenna 1 is adapted for dual frequency band applications, where the low frequency band is the frequency band located at 880~960 MHz of the GSM900 (Global System for Mobile Communications 900), and the high frequency band is the frequency band located at 1710~1880 MHz of a digital communication system (DCS).

Please refer to FIG. 1 again. Via the feeding point 13, RF signals to be transmitted by RF circuits (not shown) may be fed to the multiple frequency band antenna 1. Furthermore, the RF signal sensed by the multiple frequency band antenna 1 to the RF circuits via the feeding point 13. The first radiating element 11 is shaped like a right hand square bracket "]" and has a longer path length compared with the second radiating element 12, thereby forming a resonant mode to transmit and receive wireless signals in a low frequency band located at, for example, 880~960 MHz of the GSM900 system. The second radiating element 12 is shaped like the character "L", and the linear segment 12*a* of the second radiating element 12 that is not connected with the first radiating element 11 is located in the gap between two opposing linear segments 11*a* and 11*b* of the first radiating element 11. Consequently, the second radiating element 12 has a shorter path length compared with the first radiating element 11, and thus the second radiating element 12 can form a resonant mode to transmit and receive wireless signals in a high frequency band located at, for example, 1710~1880 MHz of the DCS system.

Referring to FIG. 2, the standing-wave ratio versus frequency relationship of the multiple frequency band antenna of FIG. 1 is shown. As shown in FIG. 2, the longitudinal axis represents the standing-wave ratio (SWR) of the multiple frequency band antenna 1 that shows a linear relationship with the gain value of the return loss. In addition, the standing-wave ratio can be converted into the gain value of the return loss through computations. It is noted that the standing-wave ratio will vary with the frequency. Generally, if the antenna 1 has a standing-wave ratio below 3 under a frequency band, it indicates that the antenna performs well under that frequency band. Hence, it can be understood from FIG. 2 that the multiple frequency band antenna 1 of FIG. 1 is adapted for the low frequency band located at 880~960 MHz of the GSM900 system, and for the high-frequency band located at 1710~1880 MHz of the DCS system.

However, the contemporary wireless communication system not only supports the GSM900 system and the digital communication system (DCS) system, but also supports the GSM850 system (Global System for Mobile Communications 850), the personal communication services (PCS) system, and the WCDMA (Wideband Code Division Multiple Access) system. The frequency bands of the GSM850 system, the PCS system and the WCDMA system are located at 824~895 MHz, 1850~1990 MHz, and 1920~2170 MHz, respectively. Since the conventional antenna is only adapted for single frequency band application or dual frequency band applications, it is obvious that the limited frequency bandwidth of the conventional antenna can not be simultaneously adapted for the GSM850 system, the GSM900 system, the DCS system, the PCS system, and the WCDMA system.

Therefore, there is a need of developing a multiple frequency band antenna with a larger frequency bandwidth for obviating the drawbacks encountered by the prior art.

SUMMARY OF THE INVENTION

An object of the present invention is to provide a multiple frequency band antenna having a plurality of radiating elements, a common feeding point and a common ground terminal for increasing the bandwidth of the antenna. The multiple frequency band antenna of the present invention is adapted for the GSM850 system, the GSM900 system, the DCS system, the PCS system, and the WCDMA system.

Another object of the present invention is to provide a multiple frequency band antenna that can increase its bandwidth without increasing dimension and size of the antenna, thereby improving the efficiency of antenna and reducing the power consumption of antenna.

In accordance with an aspect of the present invention, there is provided a multiple frequency band antenna for a wireless communication device. The multiple frequency band antenna includes a common connecting element, a first radiating element, a second radiating element, a common feeding point and a common ground terminal. The common connecting element includes a connecting part and a turning part, which are arranged in different planes. The first radiating element is connected with the connecting part of the common connecting element. The second radiating element is connected with the turning part of the common connecting element. The second radiating element has a longer path length compared with the first radiating element. The common feeding point is connected with the common connecting element. The common ground terminal is connected with the first radiating element. A combination of the common connecting element and the first radiating element is configured to transmit and receive wireless signals in a first frequency band. A combination of the common connecting element and the second radiating element is configured to transmit and receive wireless signals in a second frequency band.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 3:
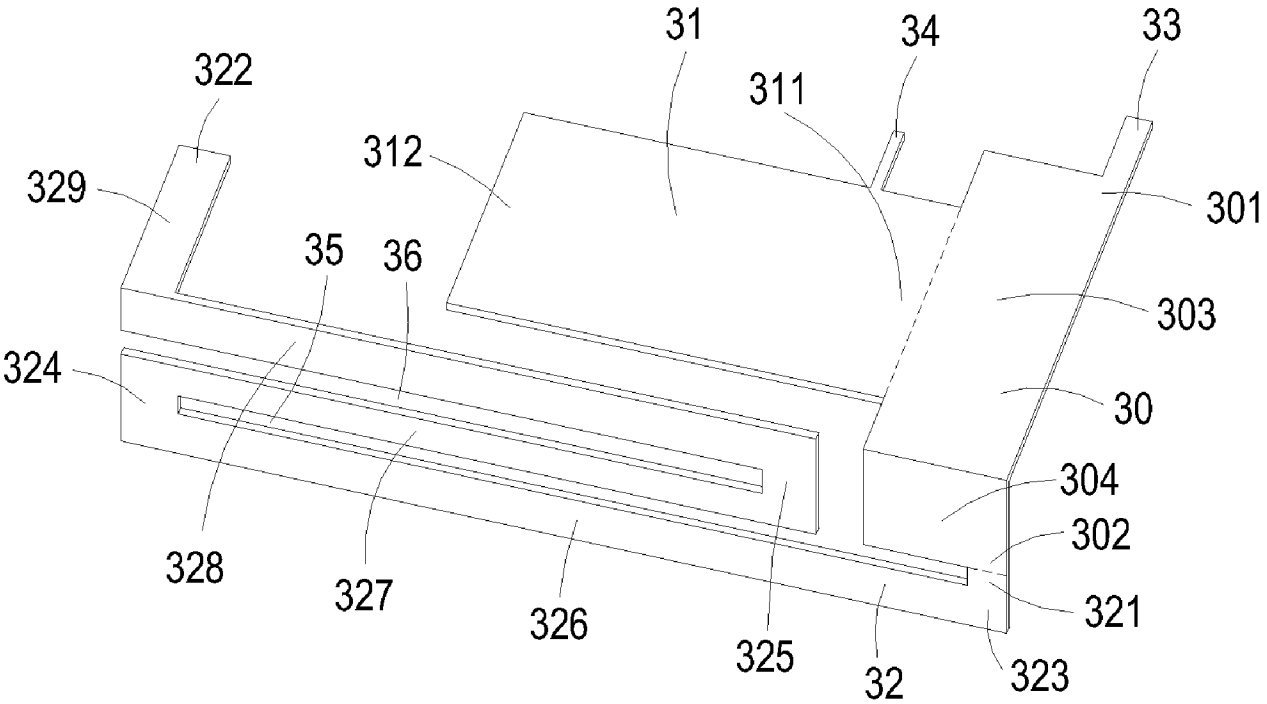
FIG. 3 is a schematic perspective view of a multiple frequency band antenna according to a preferred embodiment of the present invention.

Referring to FIG. 3, a schematic perspective view of a multiple frequency band antenna according to a preferred embodiment of the present invention is illustrated. As shown in FIG. 3, the multiple frequency band antenna 3 of the present invention is a planar inverted-F antenna. The multiple frequency band antenna 3 comprises a common connecting element 30, a first radiating element 31, a second radiating element 32, a common feeding point 33 and a common ground terminal 34. The multiple frequency band antenna 3 has a three-dimensional structure. The multiple frequency band antenna 3 may be mounted on a flexible printed circuit board (FPCB) (not shown). Due to the flexibility of the flexible printed circuit board, the multiple frequency band antenna 3 may be securely mounted in the receiving space inside the casing of a wireless communication device without the need of bending the inner wall of the receiving space.

Please refer to FIG. 3 again. The common connecting element 30 comprises a first end part 301, a second end part 302, a connecting part 303 and a turning part 304. The first radiating element 31 comprises a first end part 311 and a second end part 312. The second radiating element 32 comprises a first end part 321, a second end part 322, a first connecting part 323, a second connecting part 324, a third connecting part 325, a first linear segment 326, a second linear segment 327, a third linear segment 328 and a turning part 329.

In the three-dimensional space, the first end part 311 of the first radiating element 31 is connected with one side of the connecting part 303 of the common connecting element 30 such that the first radiating element 31 and the connecting part 303 are in the same plane or curve. In this embodiment, the first radiating element 31 and the connecting part 303 are in the same plane. Another side of the connecting part 303 of the common connecting element 30 is connected with the turning part 304 but the turning part 304 and the connecting part 303 of the common connecting element 30 are not in the same plane or curve. In this embodiment, the turning part 304 is substantially perpendicular to the connecting part 303 of the common connecting element 30. The first end part 321 of the second radiating element 32 is connected with the turning part 304 of the common connecting element 30. The first connecting part 323, the second connecting part 324, the third connecting part 325, the first linear segment 326, the second linear segment 327 and the third linear segment 328 of the second radiating element 32 are in the same plane or curve as the turning part 304 of the common connecting element 30. In some embodiments, the second end part 322 and the turning part 329 of the second radiating element 32 are not in the same plane or curve as the turning part 304 of the common connecting element 30. The turning part 329 of the second radiating element 32 is connected with the third linear segment 328 of the second radiating element 32. In this embodiment, the turning part 329 of the second radiating element 32 is substantially perpendicular to the turning part 304 of the common connecting element 30. That is, the turning part 329 of the second radiating element 32 is substantially perpendicular to the third linear segment 328 of the second radiating element 32. In addition, the turning part 329 of the second radiating element 32 is substantially perpendicular to the first radiating element 31.

One side of the first connecting part 323 of the second radiating element 32 is connected with the turning part 304 of the common connecting element 30. Another side of the first connecting part 323 of the second radiating element 32 is connected with one side of the first linear segment 326 of the second radiating element 32. Another side of the first linear segment 326 is connected with one side of the second connecting part 324 of the second radiating element 32. Another side of the second connecting part 324 is connected with one side of the second linear segment 327. Another side of the second linear segment 327 is connected with one side of the third connecting part 325 of the second radiating element 32. Another side of the connecting part 325 of the second radiating element 32 is connected with one side of the third linear segment 328 of the second radiating element 32. Another side of the third linear segment 328 is connected with one side of the turning part 329 of the second radiating element 32. From the first end part 321 to the second end part 322 of the second radiating element 32, the first connecting part 323, the first linear segment 326, the second connecting part 324, the second linear segment 327, the third connecting part 325, the third linear segment 328 and the turning part 329 are arranged in sequence. Consequently, the second radiating element 32 has a longer path length compared with the first radiating element 31. The first linear segment 326, the second linear segment 327 and the third linear segment 328 are substantially parallel with each other. The first linear segment 326 is separated from the second linear segment 327 by a first gap 35. The second linear segment 327 is separated from the third linear segment 328 by a second gap 36. In this embodiment, the widths of the first connecting part 323, the second connecting part 324, the third connecting part 325, the first linear segment 326, the second linear segment 327, the third linear segment 328 and the turning part 329 are substantially equal. The second linear segment 327 and the third linear segment 328 have substantially equal lengths but are shorter than the first linear segment 326. For example, the length of the first linear segment 326 of the second radiating element 32 is 32.2 mm, the length of the connecting part 303 of the common connecting element 30 is 14.75 mm, and the total length of the turning part 304 of the common connecting element 30 and the first connecting part 323 of the second radiating element 32 is 7.22 mm.

The common feeding point 33 is connected with another side of the connecting part 303 of the common connecting element 30. The common ground terminal 34 is connected with one side of the first radiating element 31 except the first end part 311 and the second end part 312. Via the common feeding point 33, RF signals to be transmitted by RF circuits (not shown) may be fed to the multiple frequency band antenna 3. Furthermore, the RF signal sensed by the multiple frequency band antenna 3 to the RF circuits via the common feeding point 33.

Figure 4A:
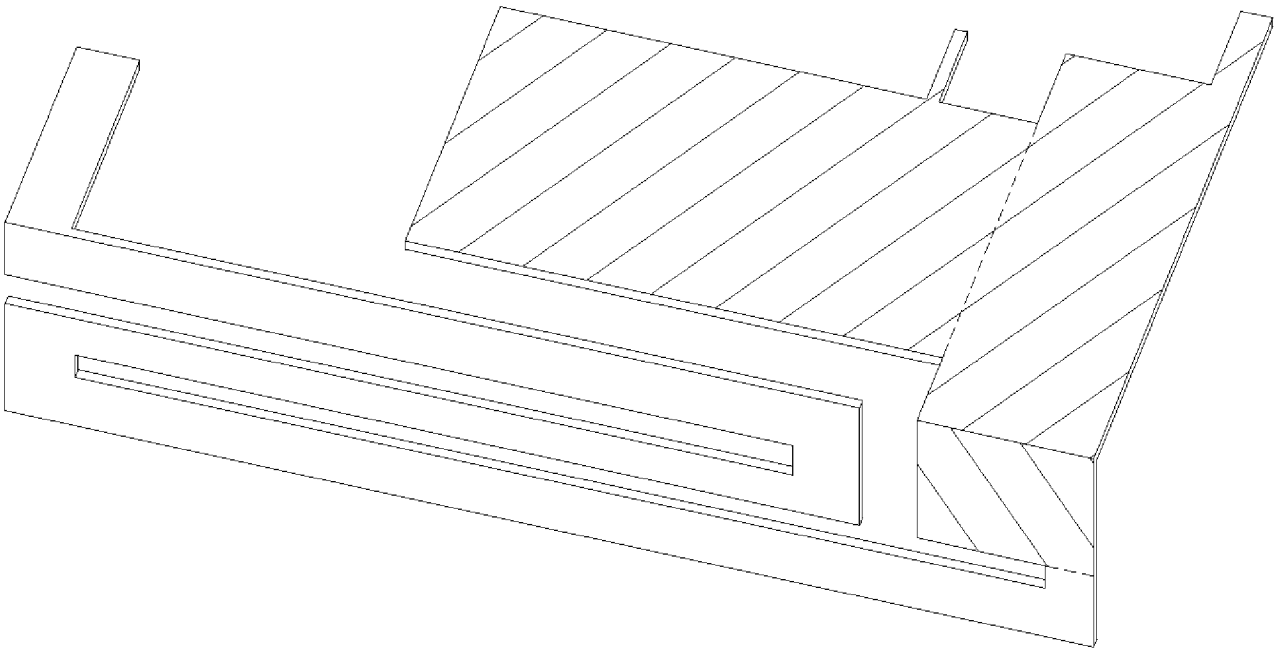
FIGS. 4A, 4B and 4C schematically illustrate three possible applications of the multiple frequency band antenna of the present invention.
Figure 4B:
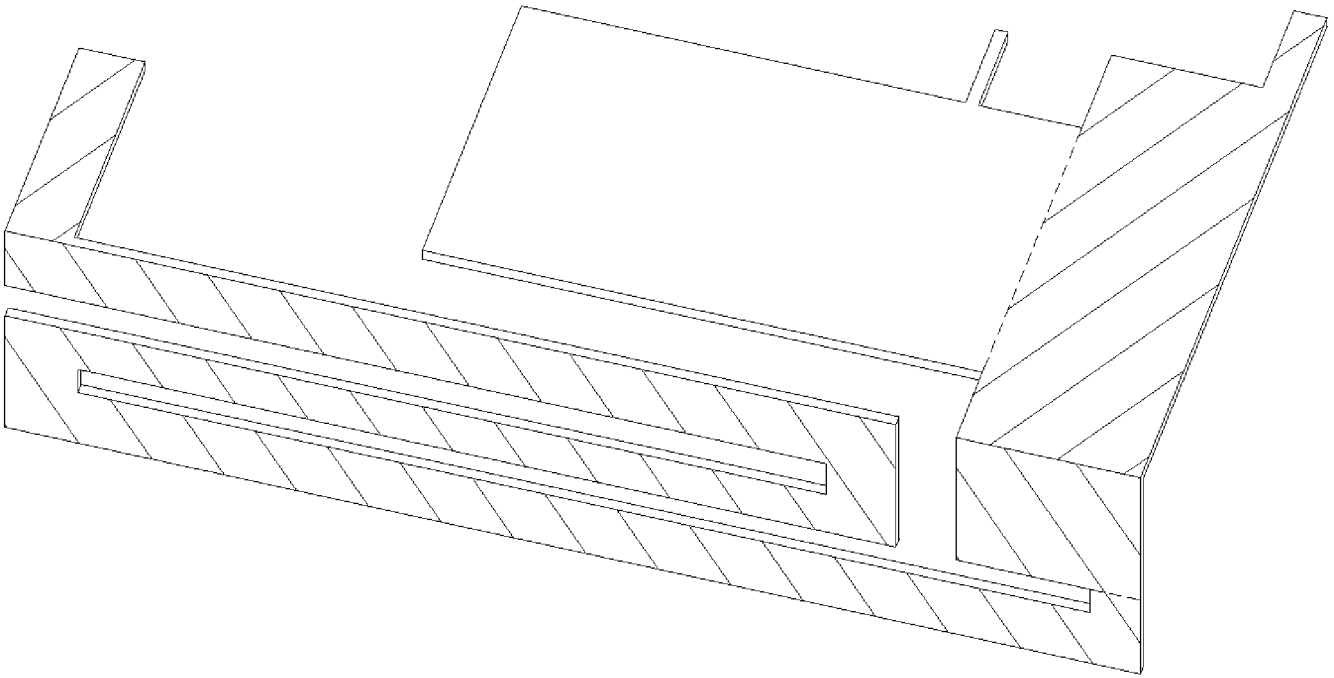
Figure 4C:
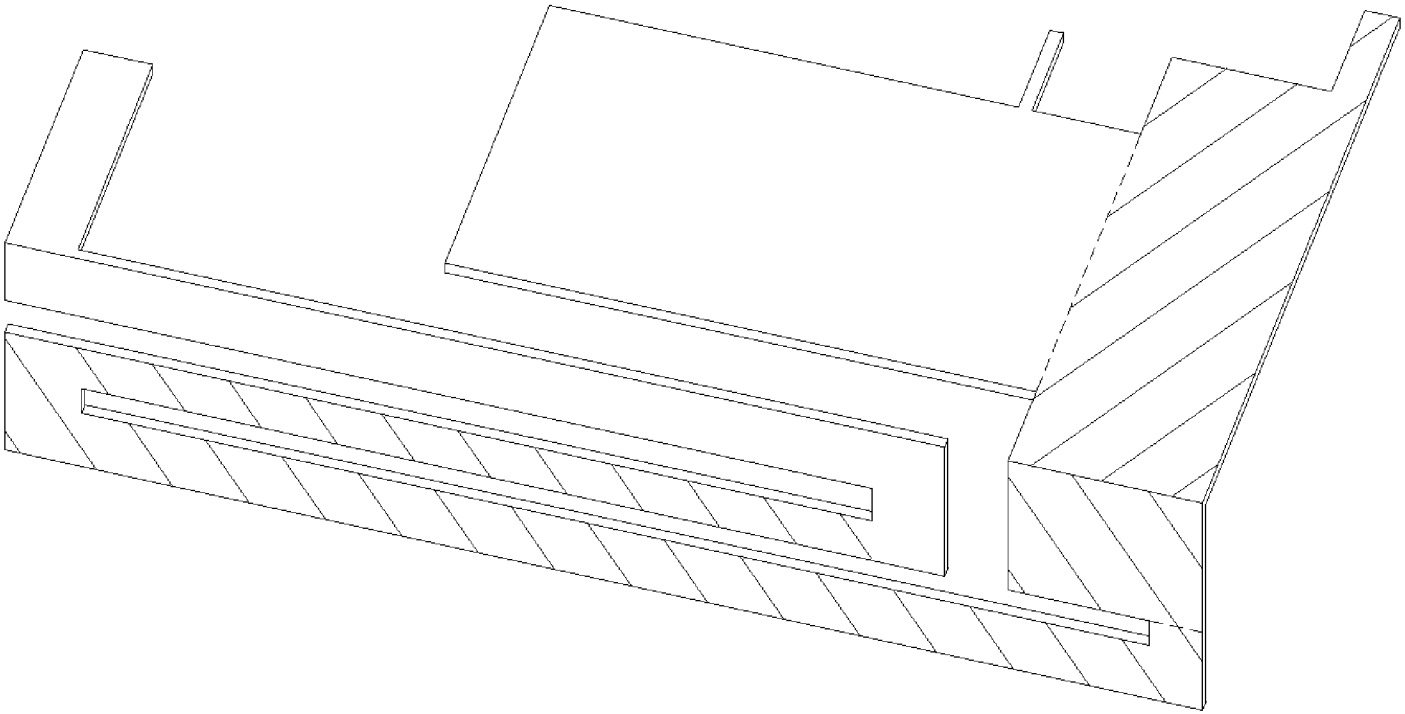

FIGS. 4A, 4B and 4C schematically illustrate three possible applications of the multiple frequency band antenna of the present invention. As shown in FIG. 4A, the combination of the common connecting element 30 and the first radiating element 31 has a relatively shorter path length, thereby forming a resonant mode to transmit and receive wireless signals in a first frequency band (e.g. a relatively higher frequency band). The first frequency band is for example located at 1710~2170 MHz. In this embodiment, the first frequency band is located at the frequency band of a digital communication system (DCS) system, a personal communication services (PCS) system, and a WCDMA system. The frequency bands of the DCS system, the PCS system and the WCDMA system are located at 1710~1880 MHz, 1850~1990 MHz and 1920~2170 MHz, respectively. As shown in FIG. 4B, the combination of the common connecting element 30 and the second radiating element 32 has a relatively shorter path length, thereby forming a resonant mode to transmit and receive wireless signals in a second frequency band (e.g. a relatively lower frequency band). The second frequency band is for example located at 824~960 MHz. In this embodiment, the second frequency band is located at the frequency band of a GSM850 system and a GSM900 system. The frequency bands of the GSM850 system and the GSM900 system are located at 824~894 MHz and 886~960 MHz, respectively. As shown in FIG. 4C, in the combination of the common connecting element 30 and the first connecting part 323, the first linear segment 326, the second connecting part 324, the second linear segment 327 of the second radiating element 32, the first gap 35 defined between the first linear segment 326, the second connecting part 324 and the second linear segment 327 (also referred as a slot mode) may facilitate the effect of transmitting and receiving RF signals in a first frequency band, thereby broadening the bandwidth of the multiple frequency band antenna 3. In this embodiment, the first frequency band is located at the frequency band of a digital communication system (DCS) system, a personal communication services (PCS) system, and a WCDMA system. The frequency bands of the DCS system, the PCS system and the WCDMA system are located at 1710~1880 MHz, 1850~1990 MHz and 1920~2170 MHz, respectively.

Figure 5:
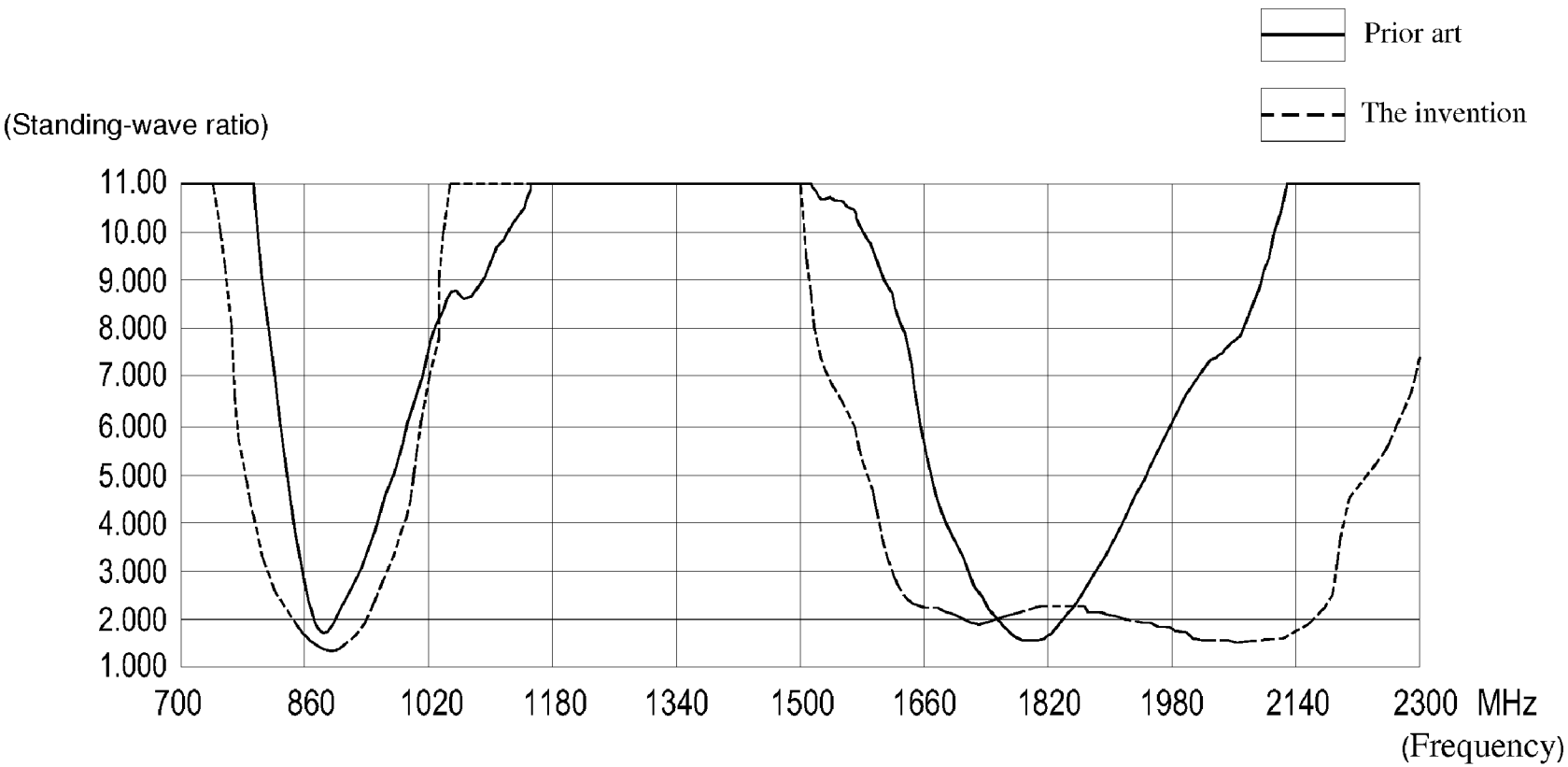
FIG. 5 is the comparison between the standing-wave ratio versus frequency relationship of the multiple frequency band antenna of FIG. 3 and the standing-wave ratio versus frequency relationship of the conventional multiple frequency band antenna.

Referring to FIG. 5, the comparison between the standing-wave ratio versus frequency relationship of the multiple frequency band antenna of FIG. 3 and the standing-wave ratio versus frequency relationship of the conventional multiple frequency band antenna is depicted. As shown in FIG. 5, the longitude axis represents the standing-wave ratio (SWR) of the multiple frequency band antenna that shows a linear relationship with the gain value of the return loss and can be converted into the gain value of the return loss through computations. It is noted that the standing-wave ratio will vary with the frequency. Generally, if the antenna has a standing-wave ratio below 3 under a frequency band, it indicates that the antenna performs well under that frequency band.

Figure 1:
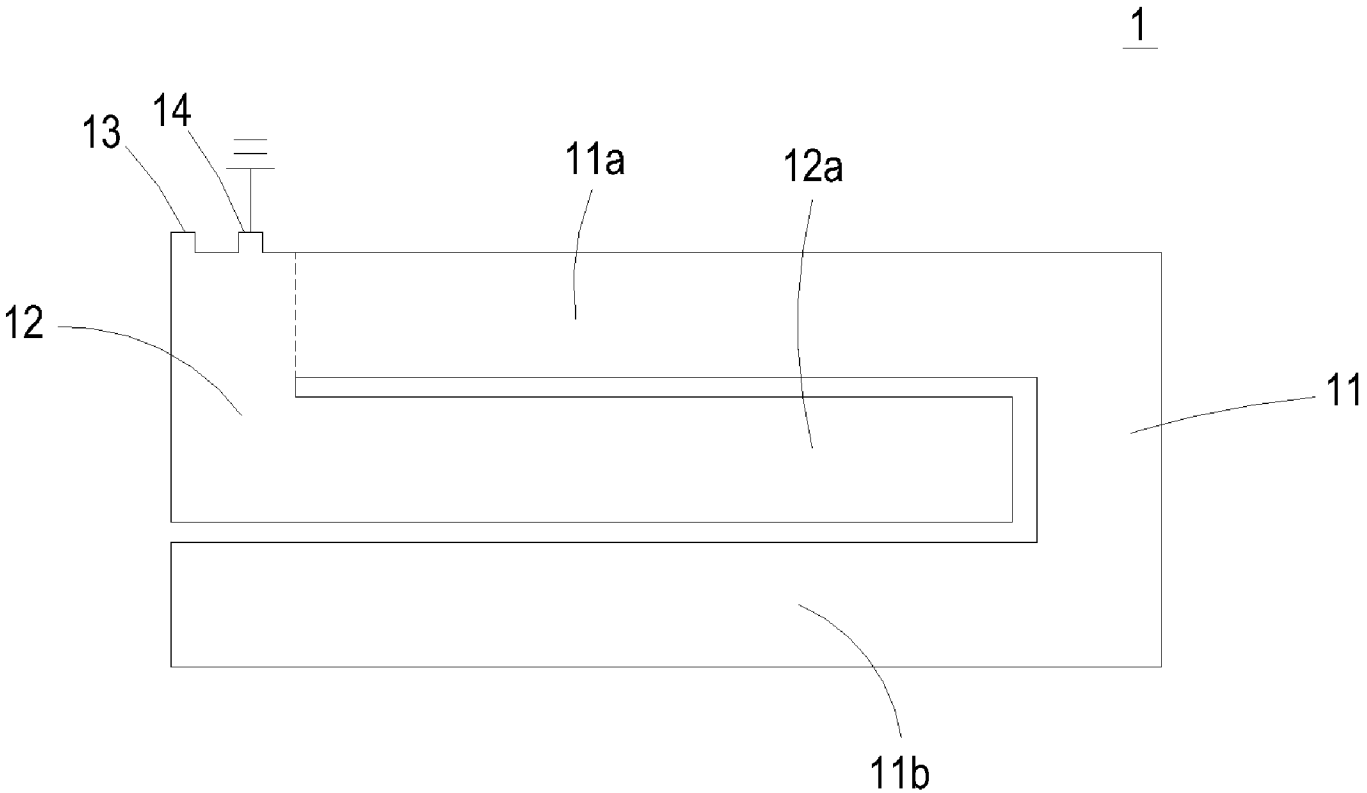
FIG. 1 PRIOR ART
FIG. 1 is a plan view showing the structure of a conventional multiple frequency band antenna.
Figure 2:
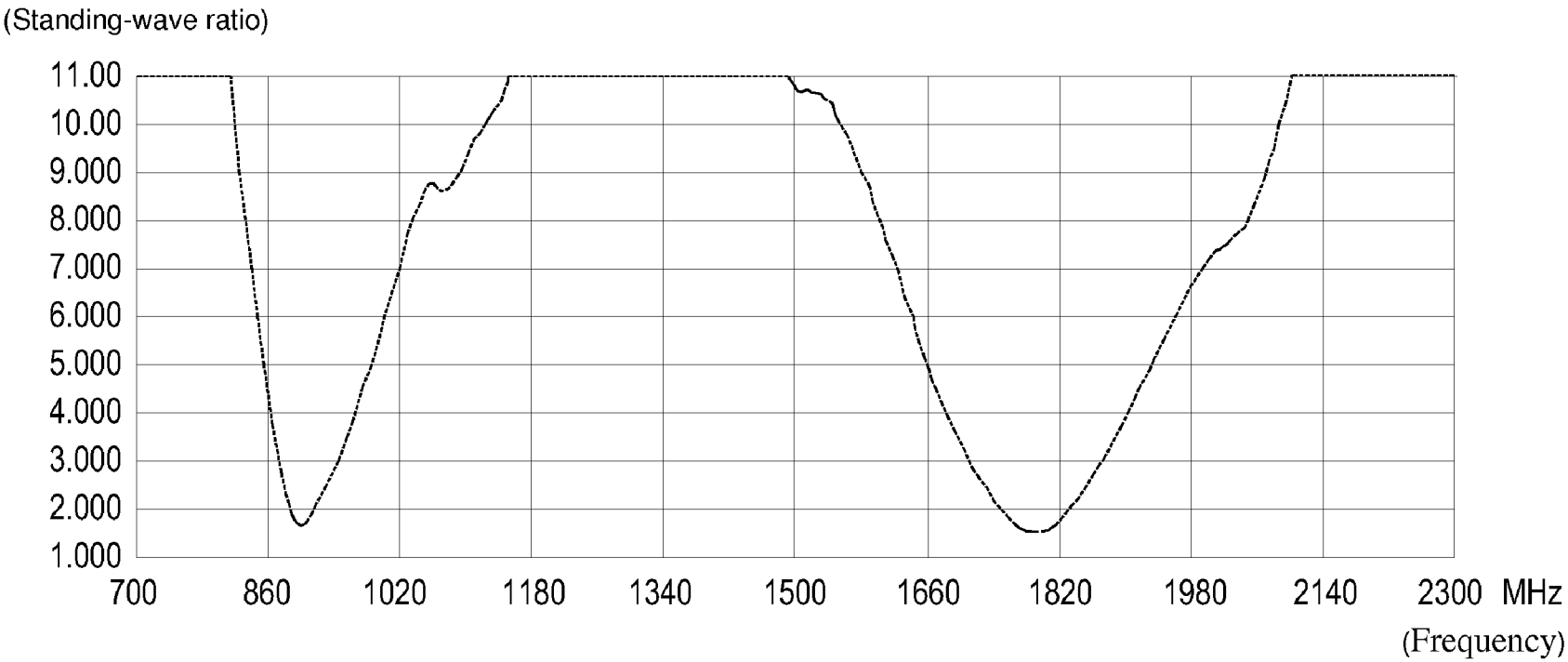
FIG. 2 PRIOR ART
FIG. 2 is a characteristic plot showing the standing-wave ratio versus frequency relationship of the multiple frequency band antenna.

It is found from FIG. 5 that the conventional antenna 1 as shown in FIG. 1 is adapted for dual frequency band application where the first frequency band and the second frequency band are located at 1710~1880 MHz and 880~960 MHz, respectively. That is, the conventional antenna 1 is adapter for the frequency band located at 1710~1880 MHz for the DCS system and 880~960 MHz for the GSM900 system.

However, the multiple frequency band antenna of the present invention is adapter for the first frequency band located at 1710~2170 MHz, for example at 1710~1880 MHz for the DCS system, 1850~1990 MHz for the PCS system, and 1920~2170 MHz for the WCDMA system. Moreover, the multiple frequency band antenna of the present invention is adapter for the second frequency band located at 824~960 MHz, for example at 824~894 MHz for the GSM850 system and 886~960 MHz for the GSM900 system. Since the first frequency band and the second frequency band for the multiple frequency band antenna of the present invention are both broader than those for the conventional antenna, the multiple frequency band antenna of the present invention may be simultaneously adapted for the GSM850 system, the GSM900 system, the DCS system, the PCS system, and the WCDMA system.

Table 1 demonstrates the gain values and the efficiencies in various frequencies for the multiple frequency band antenna of FIG. 3. Generally, the gain values above −3 and the efficiencies above 50% indicate desirable multiple frequency band antenna in terms of performance and physical characteristics. It can be understood from table 1 that the multiple frequency band antenna 3 of the present invention has a broader bandwidth to be used in the high frequency band and the low frequency band. As a consequence, the multiple frequency band antenna of the present invention may achieve good performance in the frequency bands of the GSM850 system, the PCS system, and the WCDMA system. In other words, the use of the conventional multiple frequency band antenna fails to attain the performance of the multiple frequency band antenna of the present invention. Besides, the volume and size of the multiple frequency band antenna 3 of the present invention are not considerably increased when compared with the conventional multiple frequency band antenna. Therefore, the multiple frequency band antenna of the present invention may be further developed toward minimization in its structure. As previously described, the conventional multiple frequency band antenna requires one or more feeding points and two or more ground terminals. Whereas, the multiple frequency band antenna of the present invention only requires a common feeding point and a common ground terminal, thereby simplifying the structure of the antenna.

TABLE 1

The gain values and the efficiencies in various frequencies for the multiple frequency band antenna

| Frequency band | Frequency (MHz) | Gain (dBi) | Efficiency (%) |
|---|---|---|---|
| GSM850 | 824.6 | −3.00 | 50.10 |
| | 848.8 | −2.90 | 50.97 |
| | 869.2 | −2.27 | 59.25 |
| | 893.8 | −0.94 | 80.44 |
| GSM900 | 880.2 | −1.52 | 70.36 |
| | 914.8 | −0.96 | 80.06 |
| | 925.2 | −1.53 | 70.21 |
| | 959.8 | −3.00 | 50.23 |
| DCS | 1710.2 | −2.80 | 52.37 |
| | 1784.8 | −3.00 | 50.09 |
| | 1805.2 | −2.70 | 53.59 |
| | 1879.8 | −2.71 | 53.54 |
| PCS | 1850.2 | −2.70 | 53.61 |
| | 1909.8 | −2.40 | 57.48 |
| | 1930.2 | −2.13 | 61.12 |
| | 1989.8 | −2.52 | 55.91 |
| WCDMA | 1922.4 | −2.93 | 57.58 |
| | 1977.6 | −2.32 | 58.60 |
| | 2112.4 | −2.32 | 58.57 |
| | 2167.6 | −3.00 | 50.88 |

In conclusion, the present invention provides a multiple frequency band antenna by configuring and connecting a plurality of radiating elements and a common feeding point and a common ground terminal, so as to increase the bandwidth of the antenna. Thus, the multiple frequency band antenna of the present invention can be simultaneously applied to the GSM850 system, the system, the DCS system, the PCS system and the WCDMA system. On the other hand, the multiple frequency band antenna of the present invention can increase the bandwidth of the antenna, improve the antenna efficiency, reduce the power consumption of the antenna without considerably increasing dimension and size of the antenna.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A multiple frequency band antenna for a wireless communication device, said multiple frequency band antenna comprising:

a common connecting element including a connecting part and a turning part, which are arranged in different planes;

a first radiating element connected with said connecting part of said common connecting element;

a second radiating element connected with said turning part of said common connecting element, wherein said second radiating element has a longer path length compared with said first radiating element;

a common feeding point connected with said common connecting element; and a common ground terminal connected with said first radiating element, wherein a combination of said common connecting element and said first radiating element is configured to transmit and receive wireless signals in a first frequency band, and a combination of said common connecting element and said second radiating element is configured to transmit and receive wireless signals in a second frequency band.

2. The multiple frequency band antenna according to claim 1 wherein said first frequency band includes the frequency bands of a digital communication (DCS) system, a personal communication services (PCS) system and a wideband code division multiple access (WCDMA) system.

3. The multiple frequency band antenna according to claim 1 wherein said second frequency band includes the frequency bands of a GSM850 system and a GSM900 system.

4. The multiple frequency band antenna according to claim 1 wherein said multiple frequency band antenna is mounted on a flexible printed circuit board.

5. The multiple frequency band antenna according to claim 1 wherein said first radiating element comprises a first end part and a second end part, and said second radiating element comprises a first end part, a first connecting part, a second connecting part, a third connecting part, a first linear segment, a second linear segment and a third linear segment, wherein said first connecting part, said second connecting part, said third connecting part, said first linear segment, said second linear segment and said third linear segment of said second radiating element and said turning part of said common connecting element are in the same plane or curve.

6. The multiple frequency band antenna according to claim 5 wherein said first end part of said first radiating element is connected with one side of said connecting part of said common connecting element such that said first radiating element and the connecting part are in the same plane or curve.

7. The multiple frequency band antenna according to claim 5 wherein said first end part of said second radiating element is connected with said turning part of said common connecting element.

8. The multiple frequency band antenna according to claim 5 wherein from said first end part of said second radiating element, said first connecting part, said first linear segment, said second connecting part, said second linear segment, said third connecting part and said third linear segment are arranged in sequence.

9. The multiple frequency band antenna according to claim 5 wherein said first linear segment, said second linear segment and said third linear segment of said second radiating element are substantially parallel with each other, said first linear segment is separated from said second linear segment by a first gap, and said second linear segment is separated from said third linear segment by a second gap.

10. The multiple frequency band antenna according to claim 5 wherein said first connecting part, said second connecting part, said third connecting part, said first linear segment, said second linear segment and said third linear segment of said second radiating element have substantially equal widths.

11. The multiple frequency band antenna according to claim 5 wherein said second linear segment and said third linear segment of said second radiating element have substantially equal lengths but are shorter than said first linear segment.

12. The multiple frequency band antenna according to claim 5 wherein said first linear segment of said second radiating element has a length of 32.2 mm.

13. The multiple frequency band antenna according to claim 5 wherein said turning part of the common connecting element and said first connecting part of said second radiating element has a total length of 7.22 mm.

14. The multiple frequency band antenna according to claim 5 wherein said second radiating element further comprises a turning part connected with said third linear segment of said second radiating element, and said turning part of said second radiating element and said turning part of said common connecting element are arranged in different planes.

15. The multiple frequency band antenna according to claim 14 wherein said turning part of said second radiating element is substantially perpendicular to said turning part of said common connecting element.

16. The multiple frequency band antenna according to claim 14 wherein said turning part of said second radiating element is substantially perpendicular to said first radiating element.

17. The multiple frequency band antenna according to claim 5 wherein said common feeding point is connected with one side of said common connecting element, and said common ground terminal is connected with one side of the first radiating element except said first end part and said second end part of said first radiating element.

18. The multiple frequency band antenna according to claim 1 wherein said connecting part of said common connecting element has a length of 14.75 mm.

19. The multiple frequency band antenna according to claim 1 wherein said turning part of said common connecting element is substantially perpendicular to said connecting part of said common connecting element.

* * * * *